US007588209B2

(12) United States Patent
Demers

(10) Patent No.: US 7,588,209 B2
(45) Date of Patent: Sep. 15, 2009

(54) MULTIPLE-ROLL TOILET TISSUE HOLDER AND DISPENSER

(76) Inventor: Claude Demers, 3 Berloin, Laval, Quebec (CA) H7B 1B6

( * ) Notice: Subject to any disclaimer, the term of this patent is extended or adjusted under 35 U.S.C. 154(b) by 16 days.

(21) Appl. No.: 11/701,477

(22) Filed: Feb. 2, 2007

(65) Prior Publication Data

US 2007/0181738 A1 Aug. 9, 2007

(30) Foreign Application Priority Data

Feb. 3, 2006 (GB) ..... 0602164.6

(51) Int. Cl.
*B65H 67/00* (2006.01)

(52) U.S. Cl. ..... 242/560.2; 242/559.3

(58) Field of Classification Search ..... 242/560, 242/560.2, 559.3; D6/520
See application file for complete search history.

(56) References Cited

U.S. PATENT DOCUMENTS 3,295,900 A * 1/1967 Kendall ..... 312/34.22
3,865,295 A * 2/1975 Okamura ..... 225/47
4,058,354 A * 11/1977 Powaska ..... 312/45
4,124,259 A * 11/1978 Harris ..... 312/34.22
4,432,451 A * 2/1984 Hooser ..... 206/216
5,301,888 A * 4/1994 Danzi ..... 242/560
D381,538 S * 7/1997 Smith ..... D6/520
D397,265 S * 8/1998 Badillo ..... D6/520
5,887,818 A * 3/1999 Kelley ..... 242/559.3
6,193,059 B1 * 2/2001 Massaro ..... 206/225
6,302,350 B1 * 10/2001 Burrell et al. ..... 242/560
6,422,503 B1 * 7/2002 Hoo Kong ..... 242/559.4
2007/0290092 A1 * 12/2007 Won ..... 242/560

* cited by examiner

*Primary Examiner*—William A Rivera

(57) ABSTRACT

A toilet tissue holder-dispenser for holding a toilet tissue roll and allowing dispensing of toilet tissue therefrom, the toilet tissue holder-dispenser being usable by an intended user, the toilet tissue holder-dispenser including a housing defining a spare storing section and a distinct dispensing section, the dispensing section defining a dispensing aperture, the toilet tissue roll being alternatively positionable within the spare storing section and the dispensing section, the housing defining a guiding slot extending therethrough between the spare storing and dispensing sections. A roll supporting component is provided for supporting the toilet tissue roll, the roll supporting component extending through the guiding slot, the roll supporting component defining a protruding section protruding outwardly from the housing through the guiding slot, the protruding section being graspable by the intended user, the roll supporting component being movable between a spare storing position and a dispensing position, the guiding slot guiding a movement of the roll supporting component between the spare storing and dispensing positions. Moving the roll supporting component between the spare storing and dispensing positions moves the toilet tissue roll between respectively the spare storing and dispensing sections.

13 Claims, 4 Drawing Sheets

42
40
58
58
22
26
20
22
24
20
24
28
32
30
42
40
60
22
58
20
56
36
34
52
20
18
24
22
20
18
20
28
32
30

72
66
62
68
70

MULTIPLE-ROLL TOILET TISSUE HOLDER AND DISPENSER

FIELD OF THE INVENTION

The present invention relates to the general field of toilet tissue dispensers and is particularly concerned with a multiple-roll toilet tissue holder and dispenser.

BACKGROUND OF THE INVENTION

Toilet tissue dispensers come in a variety of shapes and styles. Typically, most dispensers include two posts or prongs that extend outwardly and at a right angle from a bathroom wall. The posts are positioned far enough apart so that a spring-loaded cylinder, having a roll of tissue paper thereon, may be fitted between the posts and removably coupled thereto.

An empty roll of toilet tissue can be not only a source of embarrassment, but also an inconvenience. When a tissue roll in a home dispenser is empty, a new roll of tissue must be obtained from wherever these rolls are stored in anticipation of usage. Oftentimes, however, additional rolls of toilet tissue are not stored in a place that is convenient when needed.

While the problem resulting from an empty toilet tissue roll is often annoying in the case of a single bathroom home, it can be even more bothersome when there are two or more toilet facilities in the home. This is particularly the case when the toilet facilities are located at a remote distance from the storage cabinet used for spare rolls or tissue, such as may well be the case in a multi-floor dwelling.

Those confronted with the inconveniences of an empty roll of toilet tissue are oftentimes older persons, or persons physically incapacitated. In these cases, it is often most difficult for such a person to obtain a new roll of toilet tissue, no matter how close by the spares may be stored.

In recognition of this problem, the solution proposed in the prior is to provide two single roll dispensers in a side by side relationship relative to each other, so that a spare roll of toilet tissue will be readily available for use when, and if, needed. This type of solution has, however, typically been limited to public institutions such as office buildings, service stations and the like. Oftentimes, this solution has been found unsatisfactory, because tissue from each of the rolls is available simultaneously for use and such tissue is sometimes wasted by some users.

There have been developments, over the years, of a variety of dispensers which hold and store a multiplicity of rolls of toilet tissue. With one such dispenser commonly found in public institutions, only one roll of tissue is made available for use at a time, while another roll is held as a spare. Access to the spare roll requires a key, however, and a new roll of tissue is provided only when the janitorial service or the like makes it available. This being the case, the need for the spare roll of tissue often occurs before it becomes available.

Accordingly, there exists a need for an improved multiple-roll holder and dispenser. It is a general object of the present invention to provide such an improved multiple-roll holder and dispenser.

SUMMARY OF THE INVENTION

In a first broad aspect, the invention provides a toilet tissue holder-dispenser for holding a toilet tissue roll and allowing dispensing of toilet tissue therefrom, the toilet tissue holder-dispenser being usable by an intended user, the toilet tissue holder-dispenser comprising:

a housing, the housing defining a spare storing section and a distinct dispensing section, the dispensing section defining a dispensing aperture, the toilet tissue roll being alternatively positionable within the spare storing section and the dispensing section, the housing defining a guiding slot extending therethrough between the spare storing and dispensing sections; and a roll supporting component for supporting the toilet tissue roll, the roll supporting component extending through the guiding slot, the roll supporting component defining a protruding section protruding outwardly from the housing through the guiding slot, the protruding section being graspable by the intended user, the roll supporting component being movable between a spare storing position and a dispensing position, the guiding slot guiding a movement of the roll supporting component between the spare storing and dispensing positions;

wherein when the roll supporting component supports the toilet tissue roll, when the roll supporting component is in the spare storing position, the toilet tissue roll is located within the spare storing section;

when the roll supporting component is in the dispensing position, the toilet tissue roll is located within the dispensing section and positioned to allow dispensing of the toilet tissue from the dispensing aperture; and moving the roll supporting component between the spare storing and dispensing positions moves the toilet tissue roll between respectively the spare storing and dispensing sections.

Advantages of the present invention include that the proposed toilet tissue roll holder and dispenser allows for one roll to be supported in a dispensing position, and an additional roll or rolls to be held in a spare storing position and moved to the dispensing position when the roll in the dispensing position is exhausted. Hence, the proposed holder and dispenser is adapted to reduce the risk of living the embarrassing and inconveniencing situation of having to deal with an empty roll of toilet tissue.

Furthermore, the proposed holder and dispenser allows for the rolls in the spare storing position to be easily moved to an overlying dispensing position through a set of quick and ergonomic steps without requiring special tooling or manual dexterity.

Yet, still furthermore, the proposed holder and dispenser allows for the empty rolls to be easily moved to an empty roll storage location, again through a set of quick and ergonomical steps without requiring special tooling or manual dexterity.

Also, the proposed tissue roll holder and dispenser allows the storage or multiple spare rolls while, at the same time, covering the toilet tissue from view and providing an aesthetic and decorative external appearance.

The proposed tissue roll holder and dispenser is further designed so as to provide a structure that will be simple yet efficient and conform to conventional forms of manufacturing so as to provide a structure that will be economically feasible, long-lasting and relatively trouble-free in operation.

Other objects, advantages and features of the present invention will become more apparent upon reading of the following non-restrictive description of preferred embodiments thereof, given by way of example only with reference to the accompanying drawings.

BRIEF DESCRIPTION OF THE DRAWINGS

An embodiment of the present invention will now be disclosed, by way of example, in reference to the following drawings in which.

DETAILED DESCRIPTION

Figure 1:
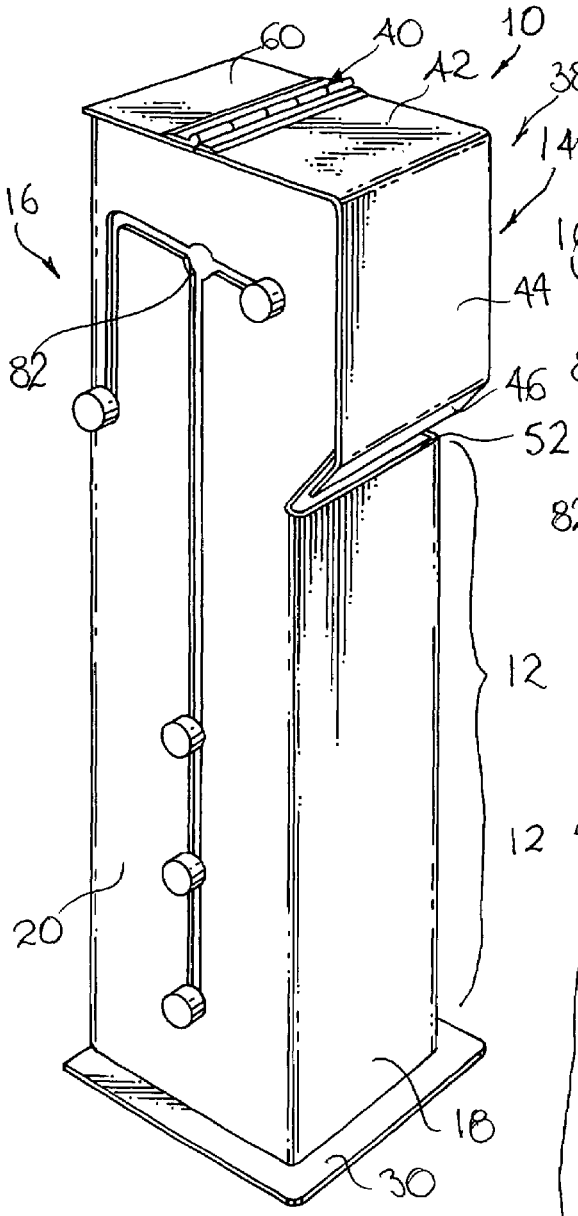
FIG. 1: in a perspective view, illustrates a toilet tissue holder-dispenser in accordance with an embodiment of the present invention.

Referring to FIG. 1, there is shown a toilet tissue holder-dispenser in accordance with an embodiment of the present invention, generally indicated by the reference numeral 10. The toilet tissue holder-dispenser 10 holds a toilet tissue roll 26 and allows dispensing of toilet tissue therefrom. The toilet tissue holder-dispenser 10 is usable by an intended user.

The toilet tissue holder-dispenser 10 includes a housing 11 defining a spare holding section 12 and a distinct dispensing section 14, the dispensing section defining a dispensing aperture 48. The toilet tissue roll 26 is alternatively positionable within the spare storing section 12 and the dispensing section 14. The housing 11 also defines a guiding slot 15 extending therethrough between the spare storing and dispensing sections 12 and 14. In some embodiments of the invention, the housing 11 further defines a supporting component storing section 16.

Figure 2:
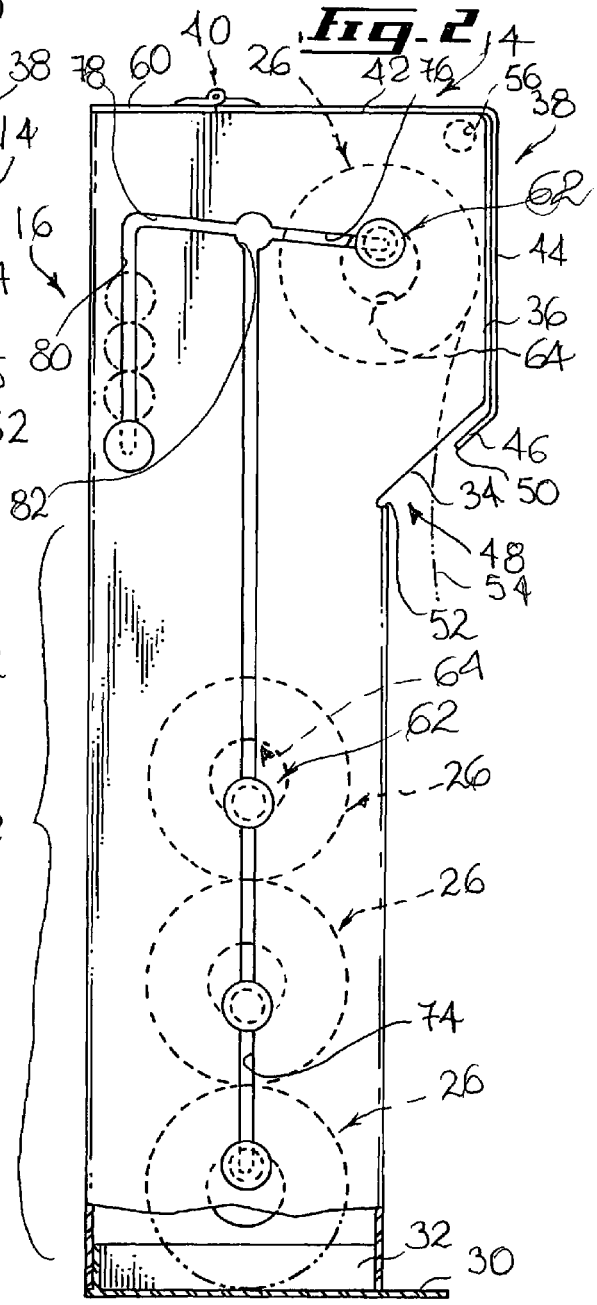
FIG. 2: in a longitudinal cross-sectional view, illustrates some of the internal features of the tissue roll holder-dispenser shown in FIG. 1, the tissue roll holder-dispenser being shown with the roll in a dispensing position, a set of spare rolls in a storage position and a set of empty rolls in an empty roll storage position.

As better shown on FIG. 2, a roll supporting component 62 is provided for supporting the toilet tissue roll 26, the roll supporting component 62 extending through the guiding slot 15. As described in further details hereinbelow, the roll supporting component 62 defines a protruding section protruding outwardly from the housing 11 through the guiding slot 15, the protruding section being graspable by the intended user. The roll supporting component 62 is movable between a spare storing position and a dispensing position, the guiding slot 15 guiding a movement of the roll supporting component 62 between the spare storing and dispensing positions. When the roll supporting 62 component supports the toilet tissue roll 26, the toilet tissue roll 26 is located within the spare storing section 12 when the roll supporting component 62 is in the spare storing position and the toilet tissue roll 26 is located within the dispensing section 14 and positioned to allow dispensing of the toilet tissue from the dispensing aperture 48 when the roll supporting component 62 is in the dispensing position. Moving the roll supporting component 62 between the spare storing and dispensing positions moves the toilet tissue roll 26 between respectively the spare storing and dispensing sections.

The spare storing section 12 typically has a generally elongated parallelepiped-shaped configuration. The spare storing section 12 typically includes a front wall 18 and a pair of side walls 20 (only one of which is shown in FIG. 1).

Figures 3, 4, 5:
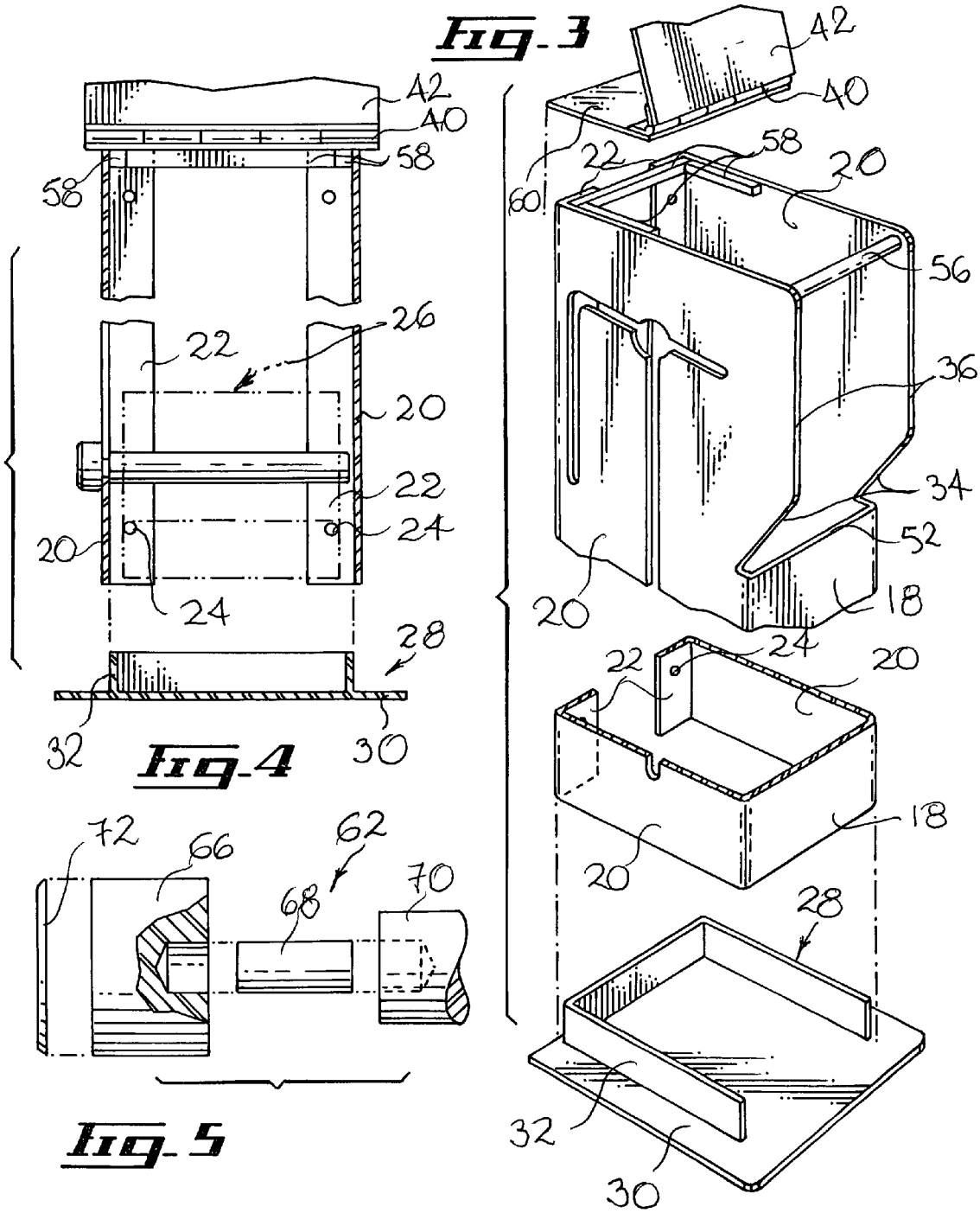
FIG. 3: in a partial exploded view with sections taken out, illustrates some of the features of the tissue roll holder-dispenser shown in FIGS. 1 and 2.
FIG. 4: in a partial longitudinal cross-sectional view with sections taken out, illustrates some of the features of tissue roll holder-dispenser shown in FIGS. 1 through 3.
FIG. 5: in a partial elevational view with sections taken out, illustrates some of the features of a tissue roll supporting component part of the tissue roll holder-dispenser shown in FIGS. 1 through 4.

As shown more specifically in FIGS. 3 and 4, the rear portion of the spare storing section 12 is typically opened. Typically, a pair of rear-mounting flanges 22 extends inwardly towards each other on the opposed side walls 20 in a substantially perpendicular relationship relative to the latter. The mounting flanges 22 are provided with mounting apertures 24 extending therethrough for allowing the toilet tissue holder-dispenser 10 to be optionally mounted or secured to a vertical surface such as a partition wall.

As shown more specifically in FIG. 2, the spare storing section 12 is configured and sized so as to be able to store at least one and typically a plurality of tissue rolls in a vertically stacked relationship relative to each other. In the embodiment shown throughout the Figures, the dispenser-holder 10 is shown adapted to store and dispense conventional toilet tissue rolls 26 (illustrated in phantom lines).

It should, however, be understood that the toilet tissue holder-dispenser 10 could be used for holding and/or dispensing other types of tissue rolls without departing from the scope of the present invention. Typically, the spare storing section 12 is configured and sized so as to be able to store the largest commercially available toilet tissue rolls 26.

As shown more specifically in FIG. 3, the toilet tissue holder-dispenser 10 typically further includes a base component 28. The base component 28 is provided with a base plate 30 adapted to be rested on a substantially horizontal supporting surface such as a floor, a tabletop or the like. The base component 28 also includes a base flange 32 extending substantially upwardly from the base plate 30. The base flange 32 is configured, sized and positioned so as to substantially fittingly receive the lower portion of the storing section 12 so as to stabilize the latter.

Hence, the holder-dispenser also can also be merely stably supported on a horizontal support surface as opposed to being mounted to a vertical supporting surface. Alternatively, the toilet tissue holder-dispenser 10 may be both supported on a horizontal supporting surface and simultaneously mounted to a vertical supporting surface.

The dispensing section 14 is typically positioned above the spare storing section 12. Furthermore, the dispensing section 14 typically projects frontwardly relative to the spare storing section 12.

Typically, the side walls 20 project substantially frontwardly from the front wall 18 defining both an angled projecting edge 34 and a parallel projecting edge 36 positioned respectively at an angle and in a parallel relationship relative to the front wall 18.

A lid 38 is typically mounted, at least partially, over the opening defined by the projecting portion of the side walls 20 about the dispensing section 14. The lid 38 is typically pivotally attached to the remainder of the toilet tissue holder-dispenser 10 by a hinge 40 or other suitable means.

Typically, although by no means exclusively, the lid 38 includes a lid horizontal portion 42, a lid vertical portion 44 and a lid angled portion 46. The lid 38 is configured and sized so as to define a dispensing aperture 48 between the distal edge 50 thereof and a peripheral edge 52 of the front wall 18. The dispensing aperture 48 is adapted to allow through passage of the unrolled free portion 54 of tissue being dispensed from the toilet tissue roll 26.

As is shown more specifically in FIG. 3, a spacing rod 56 typically extends between the forwardly projecting segments of the side walls 20 adjacent an upper corner thereof for maintaining the side walls 20 in a predetermined spaced and parallel relationship relative to each other.

As shown more specifically in FIGS. 3 and 4, a set of cover supporting rods 58 is typically attached to the side walls 20 adjacent an upper peripheral edge thereof and near a rear segment thereof. The cover supporting rods 58 are configured, sized and positioned for supporting the fixed section 60 of the lid 38 for attaching the latter to the remainder of the toilet tissue holder-dispenser 10.

As shown more specifically in FIG. 2, a roll supporting component 62 is adapted to be inserted in the central channel 64 formed by the rolls 26 for supporting the latter. As shown more specifically in FIG. 5, each roll supporting component 62 typically includes a protruding portion, which takes the form of supporting component knob 66 in the embodiment of the invention shown in FIG. 2, the supporting component knob 66 being adapted to be grasped by an intended user.

Each roll supporting component 62 also includes a cylindrical supporting component core 68 extending outwardly from the supporting component knob 66. Each roll supporting component 62 typically further includes a supporting component sleeve 70 mounted over the supporting component core 68. Optionally, a knob decorating disc 72 is mounted over the external surface of the knob 66 for improving the aesthetical appearance of the latter.

As shown more specifically in FIG. 2, a guiding slot is formed in one of the side walls 20 for allowing movement of the supporting component 62 between the spare storage section 12, the dispensing section 14 and the supporting component storage section 16. The guiding slot defines a substantially vertical and elongated slot main segment 74 allowing movement of the supporting component 62 and, hence, of the rolls 26 from the spare storage section 12 towards the dispensing and storage component storing sections 14, 16.

The guiding slot also includes a slot auxiliary segment 76 extending substantially forwardly and typically at an angle relative to the slot main segment 74 for allowing movement of the rolls 62 towards the dispensing configuration or location shown by the toilet tissue roll 26' in FIG. 2. It has been found that having the slot auxiliary segment angled at an angle of about 90 degrees or less relatively to the slot main segment is advantageous as when the slot main segment 74 is positioned substantially vertically, the slot auxiliary segment 76 is angled substantially downwardly, which stabilizes the toilet tissue roll 26' towards the dispensing section 14. However, in alternative embodiments of the invention, the slot main and auxiliary segments 74 and 76 are angled relatively to each other at any other suitable angle.

The guiding slot also includes a slot storing segment 80 for storing the roll supporting component, the slot storing segment extending from one of the slot main and auxiliary segments 74 and 76. The slot storing segment defines a slot first storing sub-segment 78 and a slot second storing sub-segment 80 extending respectively rearwardly and at an angle and in a parallel relationship downwardly relative to the slot main segment 74. The slot second storing sub-segment 80 is adapted to store spare supporting component 62 while the slot first storing sub-segment 78 is adapted to allow passage of the spare supporting component 62 towards the second slot storing sub-segment 80. However, in alternative embodiments of the invention, the slot storing segment extends in any suitable manner from one of the slot main and auxiliary segments 74 and 76.

The guiding slot also includes a slot enlarged section 82 about the intersection of the slot main segment 74, the slot dispensing section 76 and the slot first storing sub-segment 78. The slot enlarged section 82 is configured and sized for allowing through passage of the supporting component sleeve therethrough.

In use, the toilet tissue roll 26' in the dispensing position is used in a conventional manner by an intended user by pulling on the free section 54 thereof through the dispensing aperture 48. The cover distal end 50 may be used for facilitating the tearing or severing of the free portion 54.

Once the toilet tissue roll 26' is emptied from toilet tissue, the central cylinder of the toilet tissue roll 26' may be withdrawn by opening the lid 38. The empty supporting component 62 is then moved towards the supporting component storing section 16 through the slot first and second storing sub-segments 78, 80.

A fresh roll of toilet tissue 26 is then moved from the spare storing section 12 to the dispensing section 14 by sliding the corresponding supporting component 62 along the slot main segment 74 and the slot dispensing section 76. The knob 66 facilitates grasping of the supporting component 62 while the intended user slides the latter across the slot segments.

FIGS. 6 to 10 show a toilet tissue holder-dispenser 110 in accordance with another embodiment of the invention. The toilet tissue holder-dispenser 110 has many similarities with the a toilet tissue holder-dispenser 10 and only the differences between these two toilet tissue holder-dispensers are described in details hereinbelow.

Figure 6:
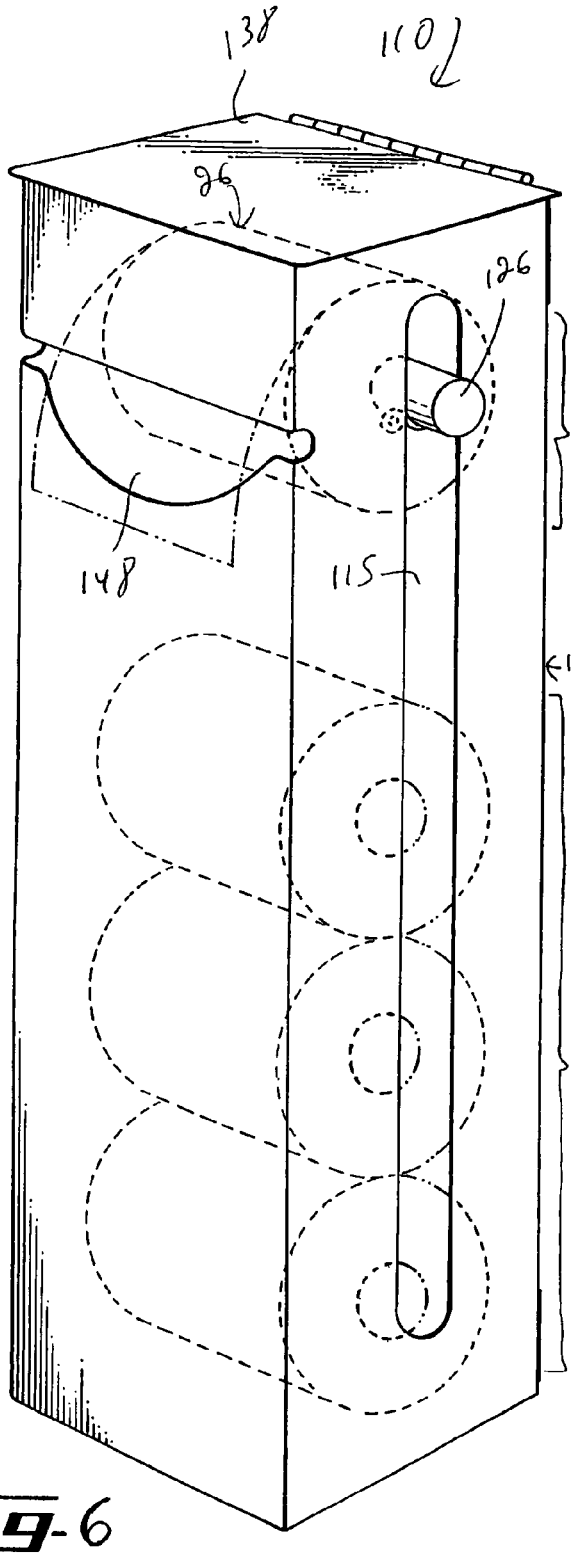
FIG. 6: in a perspective view, illustrates a toilet tissue holder-dispenser in accordance with another embodiment of the present invention.
Figure 7:
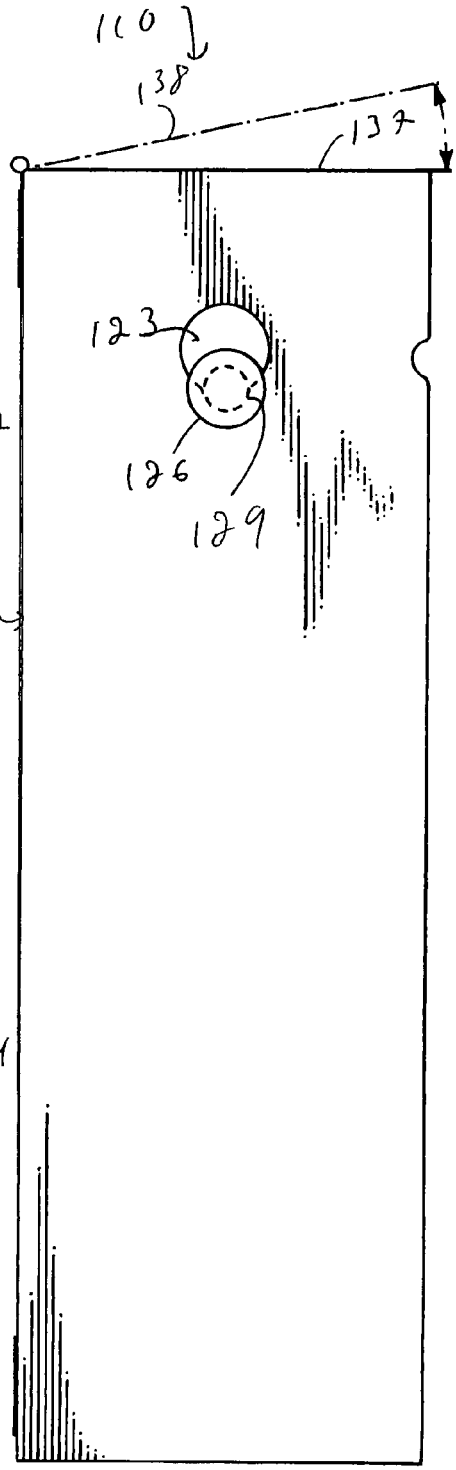
FIG. 7: in a side elevational view, illustrates the tissue roll holder-dispenser shown in FIG. 6.
Figure 8:
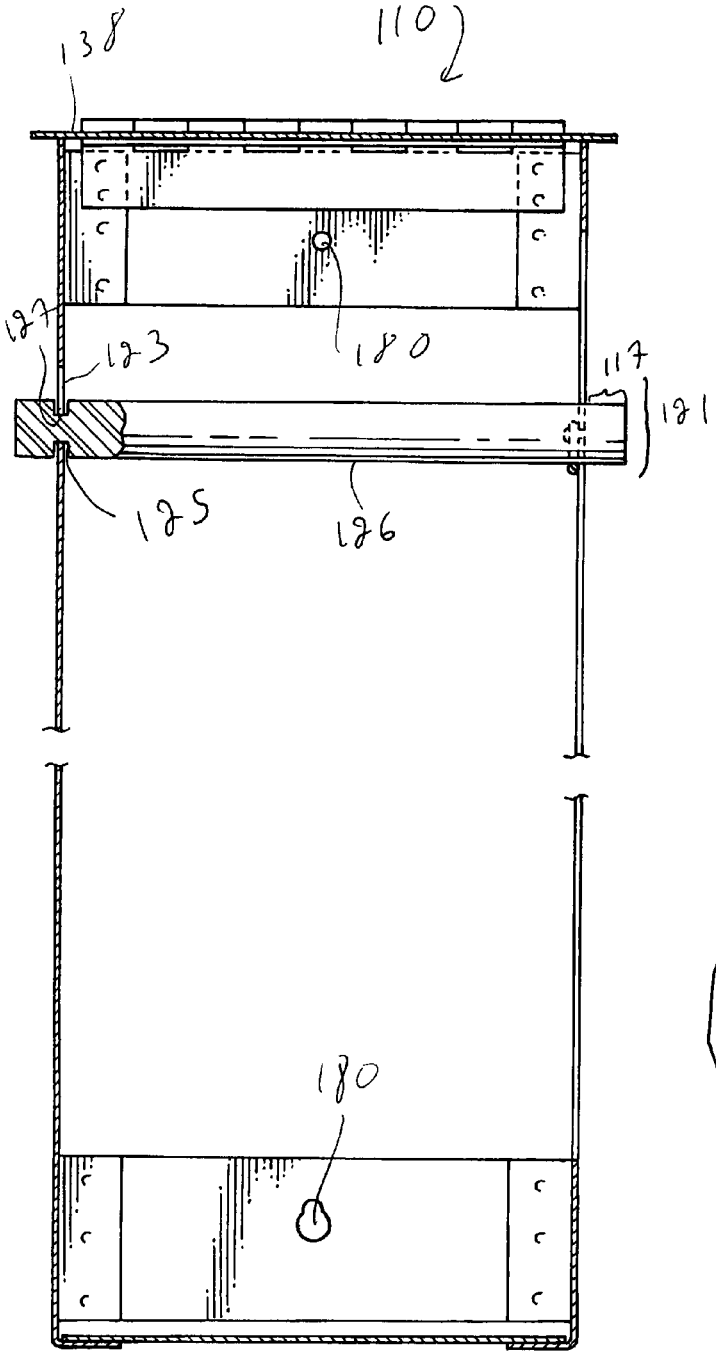
FIG. 8: in a longitudinal cross-sectional view, illustrates some of the internal features of the tissue roll holder and dispenser shown in FIGS. 6 and 7.

Referring to FIGS. 6 and 7, the a toilet tissue holder-dispenser 110 includes a housing 111 having a substantially elongated and parallelepipedic configuration, but other configurations are within the scope of the claimed invention. The toilet tissue holder-dispenser 110 defines substantially longitudinally opposed spare storing and dispensing sections 112 and 114. This configuration has an advantage of being relatively economical to manufacture. The discharge aperture 148 of the toilet tissue holder-dispenser 110 is located substantially laterally in register with the dispensing position in which the roll supporting component is when dispensing toilet tissue.

A guiding slot 115 extends through the housing 111 between the spare storing and dispensing sections 112 and 114. The guiding slot 115 is substantially rectilinear and typically extends generally vertically when the toilet tissue holder-dispenser 110 is mounted to a support surface, such as a wall. However, in alternative embodiments of the invention, the guiding slot 115 has any other suitable configuration.

A roll supporting component 126, for example a substantially elongated and substantially cylindrical roll supporting component 126, extends through the guiding slot 115. As better seen in FIG. 8, the roll supporting component defines a protruding section 117 protruding outwardly from the housing 111 through the guiding slot 115, the protruding section 117 being graspable by an intended user. The roll supporting component 126 is movable between a spare storing position and a dispensing position, the guiding slot 115 guiding a movement of the roll supporting component 126 between the spare storing and dispensing positions.

The guiding slot 115 defines a slot dispensing section 121, the roll supporting component 126 extending through the slot dispensing section 121 when the roll supporting component 126 is in the dispensing position. The housing 111 defines a supporting aperture 123 located substantially opposed and substantially in register with the slot dispensing section 121, the roll supporting component 126 extending through the supporting aperture 123 when the roll supporting component is in the dispensing position. The guiding slot 115 is configured and sized to allow through passage of the roll supporting component 126 therethrough.

In some embodiments of the invention the roll-supporting component 126 defines a substantially annular groove 125 extending substantially radially inwardly thereinto, the groove 125 defining a radially innermost wall 127. Also, the supporting aperture 123 defines a notch 129 extending substantially longitudinally towards the spare storing section 114. The notch 129 and the groove 125 are configured and sized such that the notch 125 nestingly receives the radially innermost wall 127 when the roll supporting component 126 is in the dispensing position. This configuration of the roll supporting component 126 and of the notch 125 allows to support relatively effectively and relatively stably a first end of the roll supporting component 126 in the dispensing position.

Figure 9:
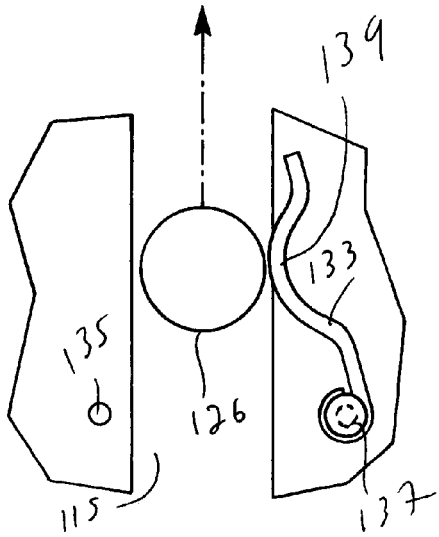
FIG. 9: in a partial longitudinal cross-sectional view with sections taken out, illustrates a latch of tissue roll holder and dispenser shown in FIGS. 6 through 8, the latch being shown in a latch accessing configuration.
Figure 10:
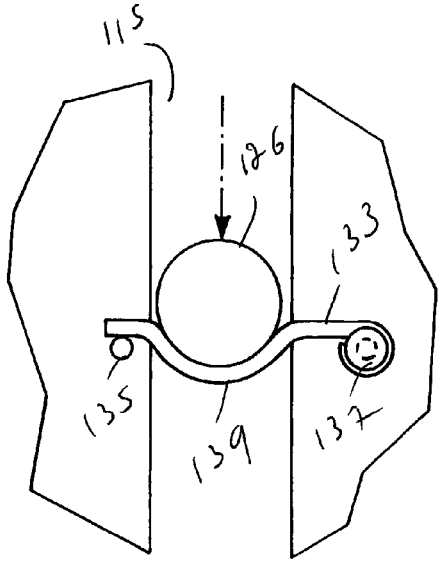
FIG. 10: in a partial longitudinal cross-sectional view with sections taken out, illustrates the latch of tissue roll holder and dispenser shown in FIGS. 6 through 9, the latch being shown in a latch retaining configuration.

To support a second end of the roll supporting component located substantially longitudinally opposed to the first end, the toilet tissue holder-dispenser 110 includes a latch operatively coupled to the housing 111 so as to be movable between a latch retaining configuration, shown in FIG. 10, and a latch accessing configuration, shown in FIG. 9. In the latch accessing configuration, the latch allows movements of the roll supporting component 126 between the spare storing and dispensing positions and in the latch retaining configuration, the latch prevents movements of the roll supporting component 126 between the spare storing and dispensing positions. Conveniently, in some embodiments of the invention, the latch is movable from the latch retaining configuration to the latch accessing configuration upon moving the roll supporting component 126 from the spare storing position to the dispensing position.

As seen in FIGS. 9 and 10, in a specific embodiment of the invention, the latch includes a lever 133 pivotally mounted to the housing 111, the lever 133 being movable between a lever retaining configuration, shown in FIG. 10, and a lever accessing configuration, shown in FIG. 9. In the lever retaining configuration, the lever 133 extends substantially across the guiding slot 115, and in the lever accessing configuration, the lever 113 is substantially retracted from the guiding slot 135. The lever 133 is attached to the housing 111 substantially adjacent to said slot dispensing section 121.

A retaining pin 135 protrudes from the housing. The retaining pin 135 is located so as to allow the lever 133 to abut thereagainst when the lever 133 is in the lever retaining configuration. For example, the retaining pin 135 is positioned substantially opposed to an attachment pivot 137 relatively to the guiding slot 115, the attachment pivot 137 being a pivot through which the lever 133 is pivotally attached to the housing 111.

In some embodiments of the invention the lever 133 defines a roll-receiving section 139, which is for example acrsegment shaped. The roll-receiving section 139 extends substantially across the guiding slot 115 when the lever 133 is in the lever retaining configuration. The roll-receiving section 139 is configured and sized for nestingly receiving the roll supporting component 126 in the dispensing position so as to support the roll supporting component 126 while allowing a rotation of the roll supporting 126 component about its longitudinal axis.

The housing 111 defines an end aperture 137 located substantially longitudinally opposed to the spare storing section 112. The toilet tissue holder-dispenser 110 also includes a lid 138, the lid 138 being movable between a closed configuration and an open configuration, wherein in the closed configuration, the lid 138 extends substantially across the end aperture 137 and in the open configuration, the lid 138 is substantially retracted from the end aperture 137. For example, but non-limitingly, the lid 138 is hingedly attached to the housing 111 substantially adjacent to the end aperture 137.

In some embodiments of the invention, the toilet tissue holder-dispenser 110 is attachable to a wall or any other suitable supporting surface using fasteners, such as conventional screws. To that effect the housing 111 defining attachment apertures 180, better seen in FIG. 8, extending therethrough for receiving the fasteners, similarly to the toilet tissue holder-dispenser 10.

In use, spare toilet tissue rolls are stored in the spare storing section 114. To bring a toilet tissue roll to the dispensing section 112, the roll supporting component 126 is inserted by the intended user through the guiding slot 115 and the central cylinder of the toilet tissue roll 26. Then, the toilet tissue roll 26 is lifted towards the dispensing section 114 using the grasping section 117. The guiding slot 115 guides the movement of the toilet tissue roll 26, which eases the operation of the toilet tissue holder-dispenser 110, which is an advantage, for example, for people having motricity problems.

When the roll supporting component 126 reaches and abuts against the lever 133, the roll supporting component 126 pivots the lever 133 towards the lever accessing configuration as it is moved towards the dispensing section 114. Once the roll supporting component 126 has cleared the lever 133, the lever 133 returns to the lever retaining configuration under the action of gravity until it abuts against the pin 135. Then the intended user positions the roll supporting component 126 so that it is supported by the notch 129 and the roll supporting section 133.

When the toilet tissue roll 26 is empty, the intended user lifts the lid 138, grabs the empty central cylinder and withdraw the roll supporting component 126 through the guiding slot 115, which allows removal of the empty central cylinder from the housing 111. This is made possible in part by the relative proximity of the lid and dispensing sections. The roll supporting component 126 can then be used once again as described hereinabove.

Although the present invention has been described hereinabove by way of preferred embodiments thereof, it can be modified, without departing from the spirit and nature of the subject invention as defined in the appended claims.

What is claimed is:

1. A toilet tissue holder-dispenser for holding a toilet tissue roll and allowing dispensing of toilet tissue therefrom, said toilet tissue holder-dispenser being usable by an intended user, said toilet tissue holder-dispenser comprising:

a housing, said housing defining a spare storing section and a distinct dispensing section, said dispensing section defining a dispensing aperture, said toilet tissue roll being alternatively positionable within said spare storing section and said dispensing section, said housing defining a guiding slot extending therethrough between said spare storing and dispensing sections; and a roll supporting component for supporting said toilet tissue roll, said roll supporting component extending through said guiding slot, said roll supporting component defining a protruding section protruding outwardly from said housing through said guiding slot, said protruding section being graspable by said intended user, said roll supporting component being movable between a spare storing position and a dispensing position, said guiding slot guiding a movement of said roll supporting component between said spare storing and dispensing positions;

wherein when said roll supporting component supports said toilet tissue roll, when said roll supporting component is in said spare storing position, said toilet tissue roll is located within said spare storing section;

when said roll supporting component is in said dispensing position, said toilet tissue roll is located within said dispensing section and positioned to allow dispensing of said toilet tissue from said dispensing aperture; and moving said roll supporting component between said spare storing and dispensing positions moves said toilet tissue roll between respectively said spare storing and dispensing sections;

said toilet tissue holder-dispenser further comprising a latch operatively coupled to said housing so as to be movable between a latch retaining configuration and a latch accessing configuration, wherein in said latch accessing configuration, said latch allows movements of said roll supporting component between said spare storing and dispensing positions and in said latch retaining configuration, said latch prevents movements of said roll supporting component between said spare storing and dispensing positions, said latch including a lever pivotally mounted to said housing, said lever being movable between a lever retaining configuration and a lever accessing configuration, wherein in said lever retaining configuration, said lever extends substantially across said guiding slot, and in said lever accessing configuration, said lever is substantially retracted from said guiding slot.

2. A toilet tissue holder-dispenser as defined in claim 1, wherein said latch is movable from said latch retaining configuration to said latch accessing configuration upon moving said roll supporting component from said spare storing position to said dispensing position.

3. A toilet tissue holder-dispenser as defined in claim 1, further comprising a retaining pin protruding from said housing, said retaining pin being located so as to allow said lever to abut thereagainst when said lever is in said lever retaining configuration.

4. A toilet tissue-holder-dispenser as defined in claim 1, wherein said lever defines a roll-receiving section extending substantially across said guiding slot when said lever is in said lever retaining configuration, said roll-receiving section being configured and sized for nestingly receiving said roll supporting component in said dispensing position so as to support said roll supporting component while allowing a rotation of said roll supporting component about its longitudinal axis.

5. A toilet tissue holder-dispenser as defined in claim 1, wherein said guiding slot defines a slot dispensing section, said roll supporting component extending through said slot dispensing section when said roll supporting component is in said dispensing position; and said housing defines a supporting aperture located substantially opposed and substantially in register with said slot dispensing section, said roll supporting component extending through said supporting aperture when said roll supporting component is in said dispensing position.

6. A toilet tissue holder-dispenser as defined in claim 5, wherein said roll-supporting component defines a substantially annular groove extending substantially radially inwardly thereinto, said groove defining a radially innermost wall;

said supporting aperture defines a notch extending substantially longitudinally towards said spare storing section said notch and said substantially annular groove being configured and sized such that said notch nestingly receives said radially innermost wall when said roll supporting component is in said dispensing position.

7. A toilet tissue holder-dispenser as defined in claim 1, wherein said housing defines an end aperture located substantially longitudinally opposed to said spare storing section, said toilet tissue holder-dispenser further comprising a lid, said lid being movable between a closed configuration and an open configuration, wherein in said closed configuration, said lid extends substantially across said end aperture and in said open configuration, said lid is substantially retracted from said end aperture.

8. A toilet tissue holder-dispenser as defined in claim 7, wherein said lid is hingedly attached to said housing substantially adjacent to said end aperture.

9. A toilet tissue holder-dispenser as defined in claim 1, wherein said discharge aperture is located substantially laterally in register with said dispensing position.

10. A toilet tissue holder-dispenser as defined in claim 1, wherein said housing is substantially elongated and said spare storing section is substantially longitudinally opposed to said dispensing section.

11. A toilet tissue holder-dispenser as defined in claim 10, wherein said guiding slot is substantially rectilinear.

12. A toilet tissue holder-dispenser as defined in claim 1, wherein said guiding slot configured and sized to allow through passage of said roll supporting component therethrough.

13. A toilet tissue holder-dispenser as defined in claim 1, wherein said toilet tissue holder-dispenser is attachable to a wall using fasteners, said housing defining attachment apertures extending therethrough for receiving said fasteners.

* * * * *